US012510303B2

(12) United States Patent
Liu et al.

(10) Patent No.: US 12,510,303 B2
(45) Date of Patent: Dec. 30, 2025

(54) VAPOR CHAMBER

(71) Applicant: PURPLE CLOUD DEVELOPMENT PTE. LTD., Singapore (SG)

(72) Inventors: Lei Lei Liu, Hui Zhou (CN); Hua-Yuan Lin, Hui Zhou (CN); Yao-Chun Wang, Taipei (TW); Zhijie Yang, Hui Zhou (CN)

(73) Assignee: PURPLE CLOUD DEVELOPMENT PTE. LTD., Singapore (SG)

( * ) Notice: Subject to any disclaimer, the term of this patent is extended or adjusted under 35 U.S.C. 154(b) by 147 days.

(21) Appl. No.: 18/373,925

(22) Filed: Sep. 27, 2023

(65) Prior Publication Data

US 2024/0310126 A1 Sep. 19, 2024

(30) Foreign Application Priority Data

Mar. 15, 2023 (CN) ..... 202310253466.1

(51) Int. Cl.
*F28D 15/02* (2006.01)

(52) U.S. Cl.
CPC ..... *F28D 15/0266* (2013.01); *F28D 15/0233* (2013.01)

(58) Field of Classification Search
CPC ..... F28D 15/0266
See application file for complete search history.

(56) References Cited

U.S. PATENT DOCUMENTS

2015/0060020 A1* 3/2015 Yang ..... F28D 15/0275 165/104.26
2020/0292243 A1* 9/2020 Liu ..... F28D 15/0233
2020/0355444 A1* 11/2020 Chen ..... F28D 15/046

* cited by examiner

*Primary Examiner* — Miguel A Diaz
*Assistant Examiner* — Khaled Ahmed Ali Al Samiri
(74) *Attorney, Agent, or Firm* — Merchant & Gould P.C.

(57) ABSTRACT

A vapor chamber includes a first cover, a second cover and a partition. The second cover and the first cover are bonded together to form a heat dissipation space. The second cover has at least two through holes. The at least two through holes correspond to the heat dissipation space. The at least two through holes are configured for at least two pipes to be inserted therein. The partition is located in the heat dissipation space, and protrudes from the first cover. The partition divides the heat dissipation space into an air tight subspace and an open subspace which are not in fluid communication with each other. The partition surrounds the open subspace. The open subspace is in fluid communication with the at least two through holes.

9 Claims, 9 Drawing Sheets

10

VAPOR CHAMBER

CROSS-REFERENCE TO RELATED APPLICATIONS

This non-provisional application claims priority under 35 U.S.C. § 119(a) on Patent Application No(s). 202310253466.1 filed in China, on Mar. 15, 2023, the entire contents of which are hereby incorporated by reference.

TECHNICAL FIELD

The present disclosure relates to a vapor chamber, more particularly to a vapor chamber having two independent spaces.

BACKGROUND

During an operation of an electronic device, a heat generated from a processor of the electronic device needs to be effectively dissipated so as to keep an operating temperature of the processor within a specific range, thereby ensuring the normal operation of the electronic device. Generally, a vapor chamber is adopted to dissipate the heat generated from the processor of the electronic device. Specifically, the vapor chamber mainly includes a chamber and a wick structure. The chamber has an interior space configured for accommodating a working fluid. The wick structure is disposed in the interior space. A heated part of the chamber is called an evaporation portion. A dissipation part of the chamber is called a condensation portion. The working fluid absorbs heat in the evaporation portion and vaporizes. The vaporized working fluid is cooled and condenses into liquid form in the condensation portion. Then, the liquid working fluid flows back to the evaporation portion via the wick structure and a cooling cycle is completed.

The working fluid in the conventional vapor chamber cools the processor uniformly. However, the temperature distribution of the heat source are not uniformly. Accordingly, the working fluid located in the high temperature areas may be excessively vaporized, thereby reducing a heat dissipation efficiency of the vapor chamber. Therefore, how to prevent the heat dissipation efficiency of the vapor chamber from being reduced due to an excessive vaporization of the working fluid is an important issue to be solved.

SUMMARY

The present disclosure provides a vapor chamber which can prevent the heat dissipation efficiency of the vapor chamber from being reduced due to an excessive vaporization of the working fluid.

One embodiment of the disclosure provides a vapor chamber including a first cover, a second cover and a partition. The second cover and the first cover are bonded together to form a heat dissipation space. The second cover has at least two through holes. The at least two through holes correspond to the heat dissipation space. The at least two through holes are configured for at least two pipes to be inserted therein. The partition is located in the heat dissipation space, and protrudes from the first cover. The partition divides the heat dissipation space into an air tight subspace and an open subspace which are not in fluid communication with each other. The partition surrounds the open subspace. The open subspace is in fluid communication with the at least two through holes.

According to the vapor chamber as described in the above embodiments, the partition divides the heat dissipation space into an air tight subspace and an open subspace which are not in fluid communication with each other, and the second working fluid located in the open subspace and cooling the hot spot of the heat source is driven by the external pump to reduce the time for the second working fluid to stay in open subspace. Thus, less heat generated by the hot spot of the heat source is transferred to the first working fluid located in the air tight subspace from the second working fluid via partition. Accordingly, the first working fluid located outside the hot spot of the heat source may not be excessively vaporized due to the heat generated by the hot spot so as to prevent the heat dissipation efficiency of the vapor chamber from being reduced.

In addition, the first working fluid located outside the hot spot of the heat source can cool the heat generated from a part of the heat source other than the hot spot, and the second working fluid can mainly cool the heat generated from the hot spot of the heat source. Therefore, the hot spot is allowed to be cooled via the second working fluid by a low wattage and low flow external pump, which improves a design freedom of the vapor chamber.

BRIEF DESCRIPTION OF THE DRAWINGS

The Present Disclosure Will Become More Fully Understood from the Detailed Description Given Hereinbelow and the Accompanying Drawings which are Given by Way of Illustration Only and Thus are not Limitative of the Present Disclosure and Wherein.

DETAILED DESCRIPTION

Figure 1:
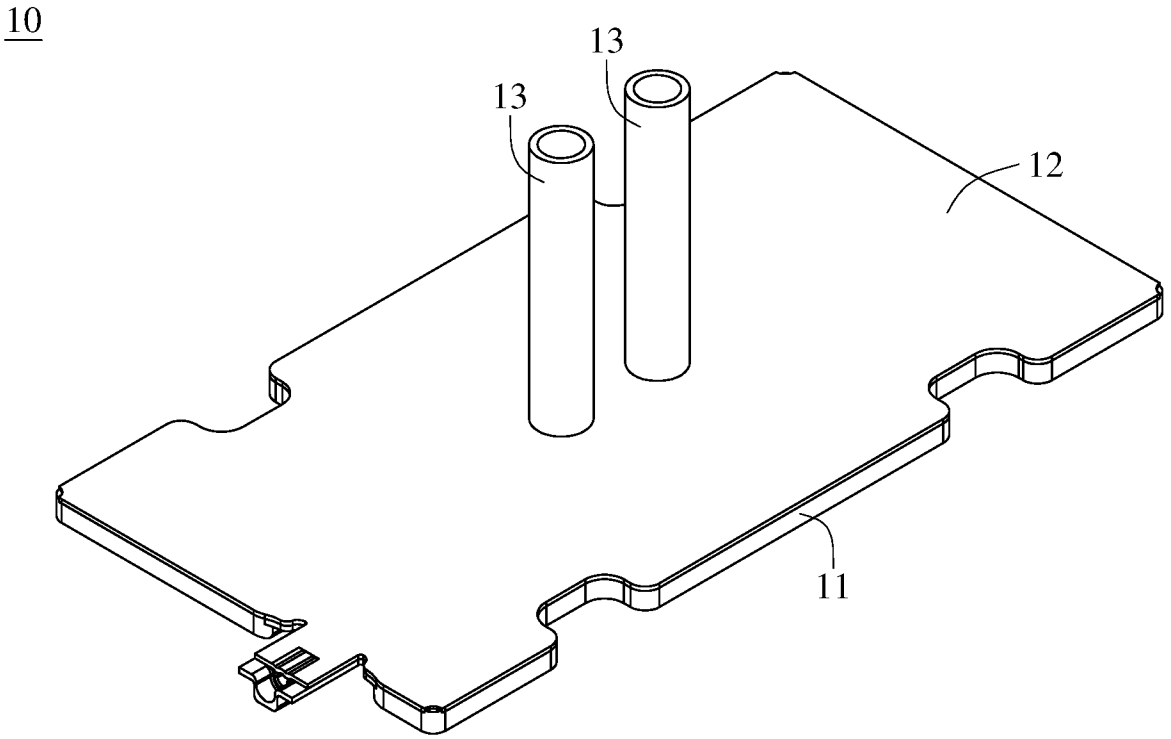
FIG. 1 is a perspective view of a vapor chamber in accordance with a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
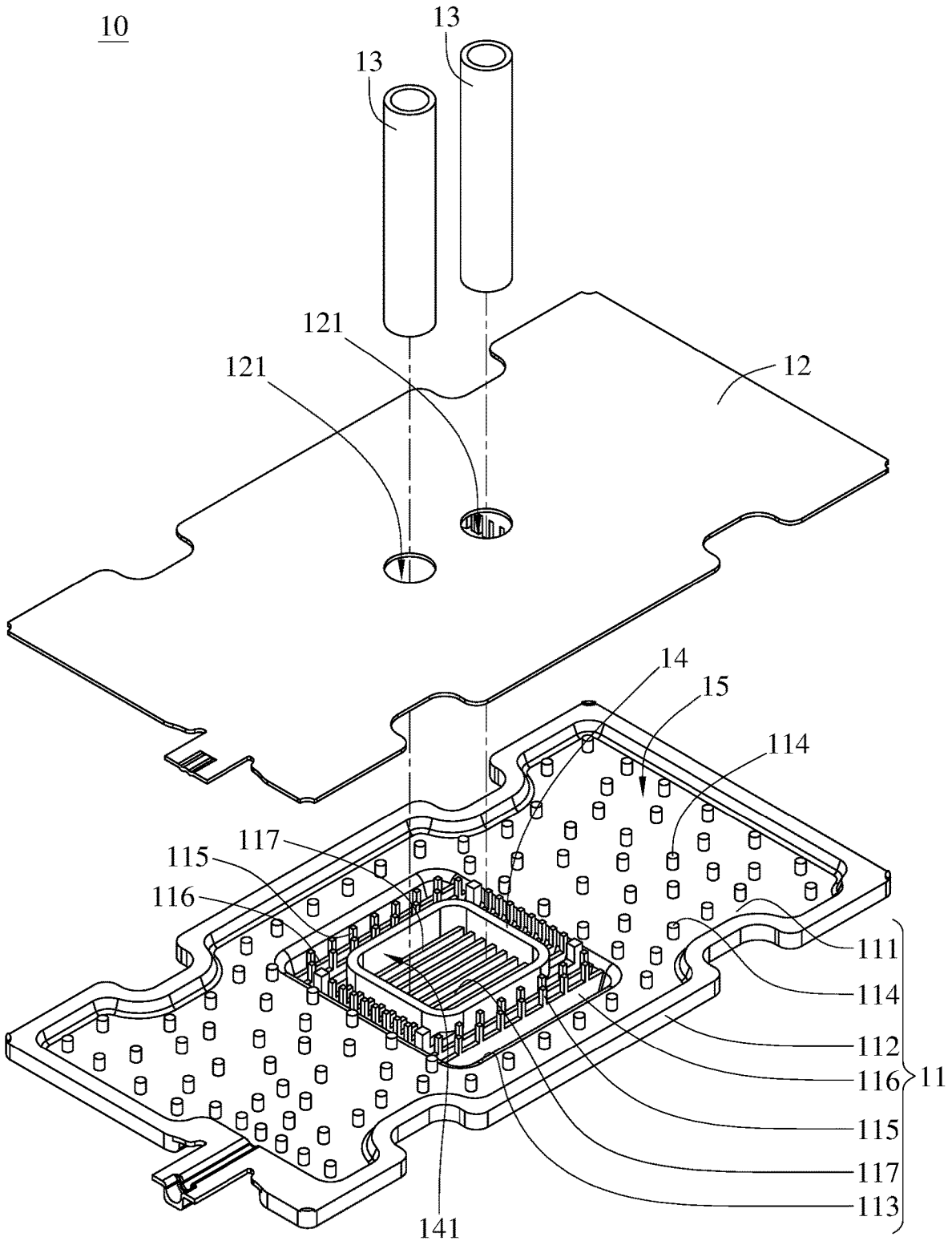
FIG. 2 is an exploded view of the vapor chamber in FIG. 1.
Figure 3:
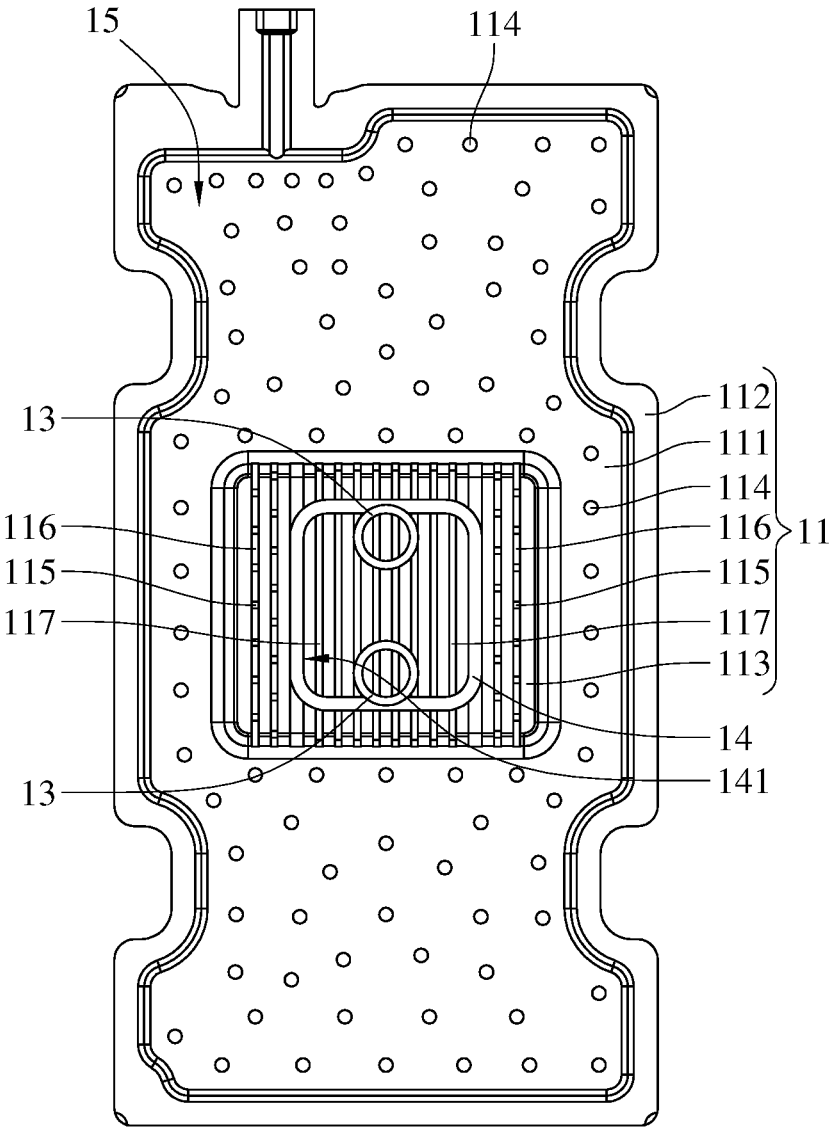
FIG. 3 is a top view of the vapor chamber in FIG. 1 omitting a second cover.

Please refer to FIG. 1 to FIG. 3, where FIG. 1 is a perspective view of a vapor chamber 10 in accordance with a first embodiment of the disclosure, FIG. 2 is an exploded view of the vapor chamber 10 in FIG. 1, and FIG. 3 is a top view of the vapor chamber 10 in FIG. 1 omitting a second cover 12.

In this embodiment, the vapor chamber 10 includes a first cover 11, a second cover 12, two pipes 13 and a partition 14. The first cover 11 and the second cover 12 are, for example, thermally conductive metal covers. The second cover 12 and the first cover 11 are bonded together to form a heat dissipation space 15. The second cover 12 has two through holes 121. The two through holes 121 correspond to the heat dissipation space 15. The two pipes 13 are inserted into and in fluid communication with the two through holes 121, respectively. The two pipes 13 are connected to the second cover 12 via, for example, welding.

Figure 4:
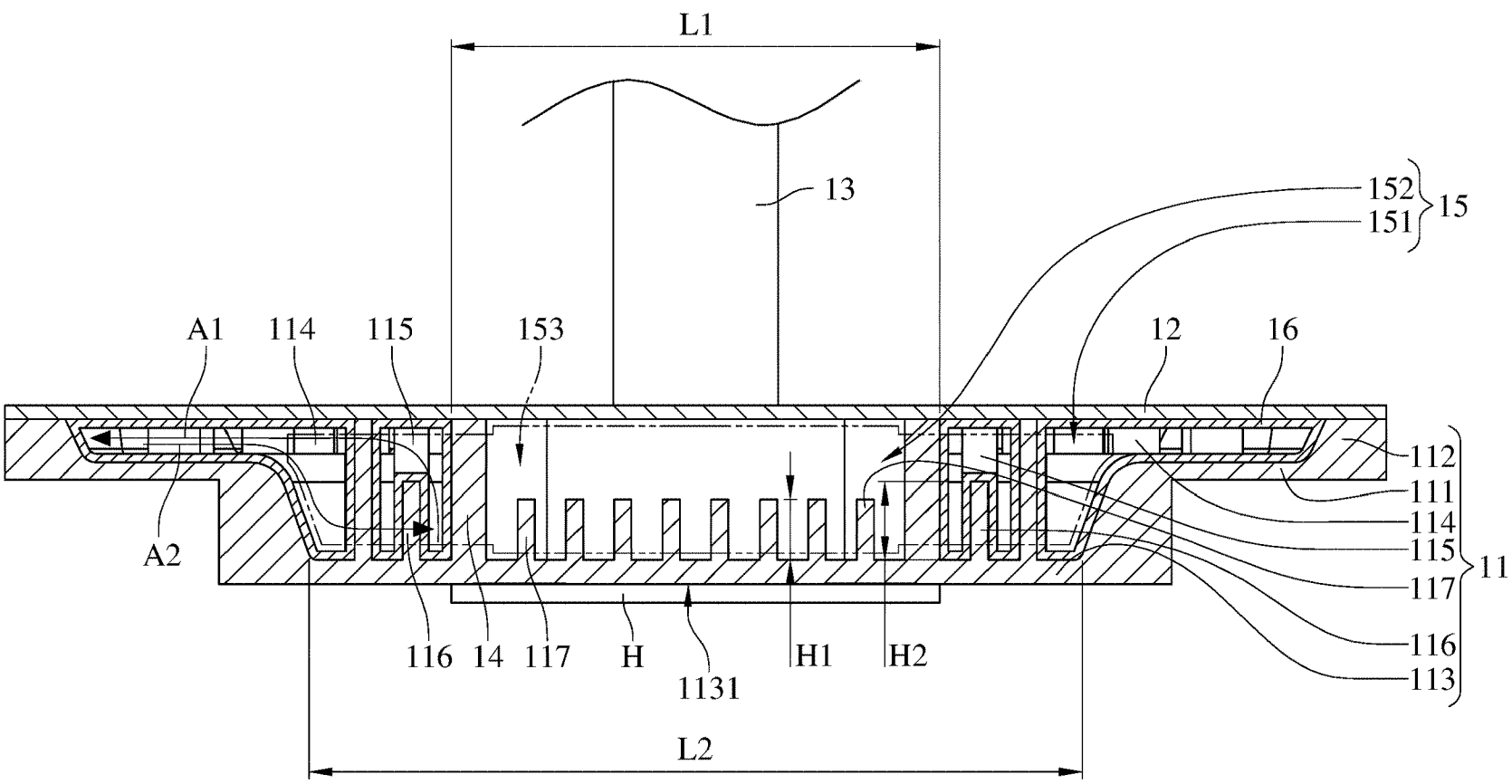
FIG. 4 is a cross-sectional view of the vapor chamber in FIG. 1.
Figure 5:
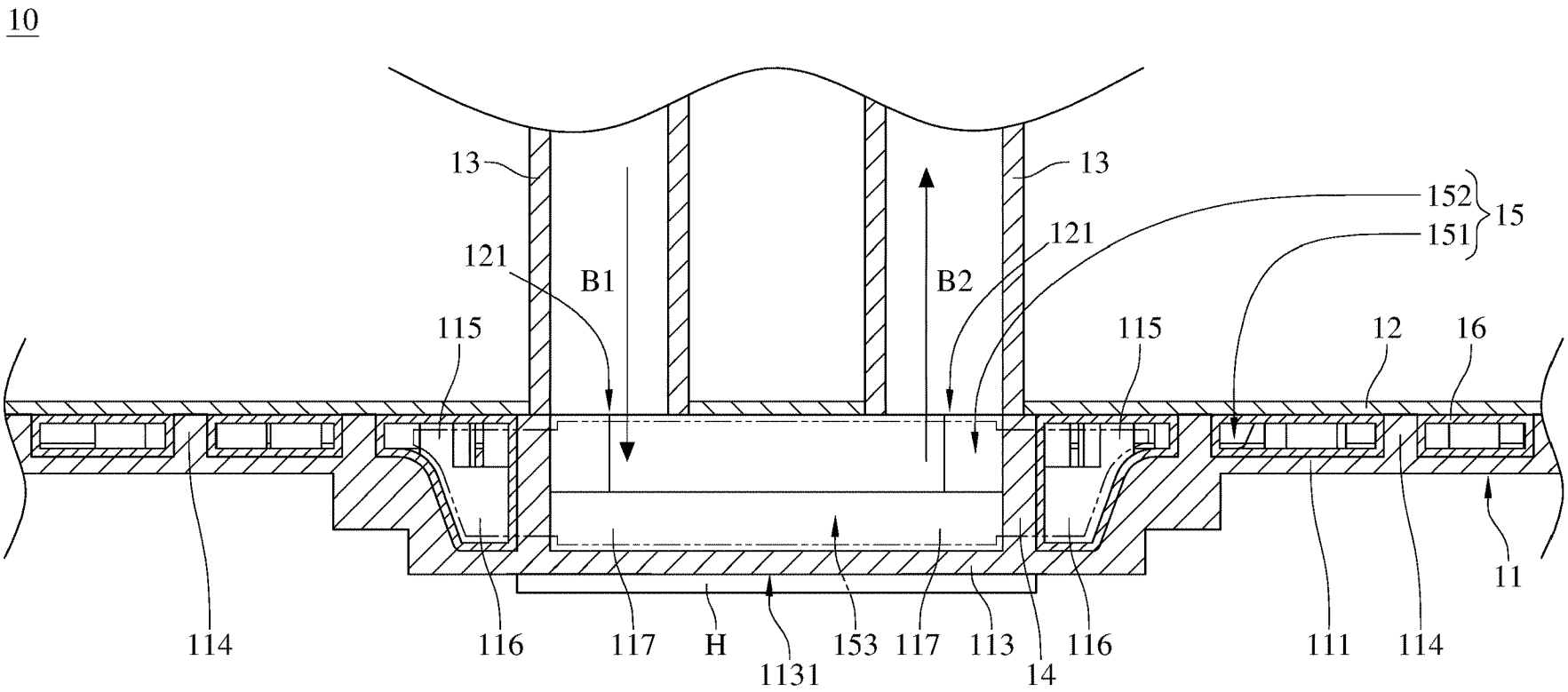
FIG. 5 is another cross-sectional view of the vapor chamber in FIG. 1.

Please refer to FIG. 4 and FIG. 5, where FIG. 4 is a cross-sectional view of the vapor chamber 10 in FIG. 1, and FIG. 5 is another cross-sectional view of the vapor chamber 10 in FIG. 1.

The partition 14 is, for example, a thermally conductive metal partition. The partition 14 is located in the heat dissipation space 15, and protrudes from the first cover 11. The partition 14 is bonded to the second cover 12. The partition 14 divides the heat dissipation space 15 into an air tight subspace 151 and an open subspace 152 which are not in fluid communication with each other, and the partition 14 surrounds the open subspace 152. That is, the air tight subspace 151 and the open subspace 152 are two independent spaces. The air tight subspace 151 is configured to accommodate a first working fluid (not shown). The first working fluid is, for example, water or refrigerant. The open subspace 152 is configured to accommodate a second working fluid (not shown). The second working fluid is, for example, water or refrigerant. Since the first working fluid and the second working fluid are located in the two independent spaces, respectively, the first working fluid and the second working fluid are prevented from being mixed. The open subspace 152 is in fluid communication with the two through holes 121, such that the open subspace 152 is in fluid communication with the two pipes 13 via the two through holes 121, respectively. The two pipes 13 are configured to be connected to an external pump (not shown). The external pump can drive the second working fluid to flow between the two pipes 13 and the open subspace 152.

The first cover 11 includes a plate 111, a frame 112, a thermally conductive protrusion 113, a plurality of first supporting structures 114, a plurality of second supporting structures 115, a plurality of thermally conductive protruding plates 116 and a plurality of fins 117. The frame 112 surrounds the plate 111. The thermally conductive protrusion 113 protrudes from the plate 111 along a direction away from the heat dissipation space 15. The heat dissipation space 15 has a vaporization area 153 corresponding to the thermally conductive protrusion 113. The thermally conductive protrusion 113 has a thermal contact surface 1131 facing away from the vaporization area 153. An orthogonal projection of the vaporization area 153 onto the thermal contact surface 1131 is entirely located within the thermal contact surface 1131. The thermal contact surface 1131 faces away from the heat dissipation space 15. Also, the thermal contact surface 1131 faces away from the second cover 12. The thermal contact surface 1131 is configured to be thermally coupled to a heat source H. The so-called "thermally coupled" refers to a thermal contact or a connection via other thermally conductive media. The two pipes 13 and the partition 14 are located in the vaporization area 153. The partition 14 protrudes from the thermally conductive protrusion 113. A length L1 of the partition 14 is, for example, ½ to ⅔ of a length L2 of the thermally conductive protrusion 113. After the thermally conductive protrusion 113 absorbs the heat generated from the heat source H, the heat can be transferred to the first working fluid located in the air tight subspace 151 and the second working fluid located in the open subspace 152, thereby cooling the heat source H.

In this embodiment, an area of the orthogonal projection of the vaporization area 153 onto the thermal contact surface 1131 can be changed with a contact area between the heat source H and the thermal contact surface 1131. In addition, the partition 14 located in the vaporization area 153 corresponds to, for example, a hot spot of the heat source H. A cross-section area of the air tight subspace 151 surrounded by an inner surface 141 of the partition 14 is, for example, equal to a contact area between the heat source H and the thermal contact surface 1131. Accordingly, the second working fluid located in the open subspace 152 surrounded by the partition 14 can absorb the heat transferred from the heat spot of the heat source H to the thermally conductive protrusion 113 via the thermal contact surface 1131.

In this embodiment, the first working fluid located in the air tight subspace 151 is vaporized after absorbing the heat generated from the heat source H, and flows along a direction A1. Then, the vaporized first working fluid flows along a direction A2 opposite to the direction A1. The external pump drives the second working fluid to flow into the open subspace 152 along a direction B1. Then, the second working fluid flows along a direction B2 opposite to the direction B1 after absorbing the heat generated from the heat source H. That is, in the vapor chamber 10, an area corresponds to the heat spot of the heat source His cooled via the second working fluid driven by the external pump, and an area whose temperature is lower than that of the hot spot is cooled via the first working fluid located in the air tight subspace 151.

Generally, an excessive vaporization of a working fluid may be caused in a conventional vapor chamber with only a single space due to a high temperature of a heat source, thereby reducing a heat dissipation efficiency of the vapor chamber. Compared with the conventional vapor chamber, the vapor chamber 10 in this embodiment has two independent spaces for heat dissipation in areas with different temperatures, respectively. The second working fluid cooling the hot spot of the heat source H is driven by the external pump to reduce the time for the second working fluid to stay in open subspace 152. Thus, less heat generated by the hot spot of the heat source H is transferred to the first working fluid located in the air tight subspace 151 from the second working fluid via partition 14. Accordingly, the first working fluid located outside the hot spot of the heat source H may not be excessively vaporized due to the heat generated by the hot spot so as to prevent the heat dissipation efficiency of the vapor chamber 10 from being reduced. In addition, the first working fluid located outside the hot spot of the heat source H can cool the heat generated from a part of the heat source H other than the hot spot, and the second working fluid can mainly cool the heat generated from the hot spot of the heat source H. Therefore, the hot spot is allowed to be cooled via the second working fluid by a low wattage and low flow external pump, which improves a design freedom of the vapor chamber 10.

The first supporting structures 114 and the second supporting structures 115 are, for example, columnar. The first supporting structures 114 and the second supporting structures 115 protrude toward and contact the second cover 12 from the plate 111 and the thermally conductive protrusion 113, respectively. Accordingly, the first supporting structures 114 and the second supporting structures 115 can support the first cover 11 and the second cover 12 of the vapor chamber 10 to prevent expansion or deformation of the heated the vapor chamber 10.

The thermally conductive protruding plates 116 are located in the air tight subspace 151. The thermally conductive protruding plates 116 protrude from the thermally conductive protrusion 113, and are connected to the second supporting structures 115. The thermally conductive protruding plates 116 are arranged around the partition 14. The fins 117 are located in the open subspace 152. A height H1 of each fin 117 is, for example, ½ to ⅔ of a height H2 of each thermally conductive protruding plates 116. The thermally conductive protruding plates 116 and the fins 117 further facilitate the heat generated from the heat source H to be transferred from the thermally conductive protrusion 113 to the first working fluid and the second working fluid so as to improve the heat dissipation efficiency of the vapor chamber 10.

In this embodiment, the vapor chamber 10 further includes a wick structure 16. The wick structure 16 are selected from a group consisting of a metal mesh, a sintered powder structure and sintered ceramic structure. The wick structure 16 is located in the air tight subspace 151, and is stacked on a side of the first cover 11, a side of the second cover 12 and an outer side of the partition 14. The outer side of the partition 14 is located farthest away from the open subspace 152.

In this embodiment, since the wick structure 16 is stacked on the outer side of the partition 14, the vaporized first working fluid can flow along the direction A2 via the wick structure 16. In addition, since the outer side of the partition 14 is exposed to the air tight subspace 151, a longer wick structure 16 can be disposed in the vapor chamber 10 since the outer side of the partition 14 is allowed for the wick structure 16 to be stacked thereon. In this way, the vaporized first working fluid can more efficiently flow along the direction A2 via the wick structure 16.

In this embodiment, the vapor chamber 10 includes the two pipes 13, and the second cover 12 has the two through holes 121, but the disclosure is not limited thereto. In other embodiments, the vapor chamber may include three or more pipes, and the second cover may have three or more through holes.

In this embodiment, the partition 14 located in the vaporization area 153 corresponds to the heat spot of the heat source H, but the disclosure is not limited thereto. In other embodiments, the partition may correspond to places other than the hot spot of the heat source in the vaporization area.

In this embodiment, the first cover 11 includes the plurality of first supporting structures 114, the plurality of second supporting structures 115 and the plurality of thermally conductive protruding plates 116, but the disclosure is not limited thereto. In other embodiments, the first cover may include one first supporting structure, one second supporting structure and one thermally conductive protrusion merely.

Figure 6:
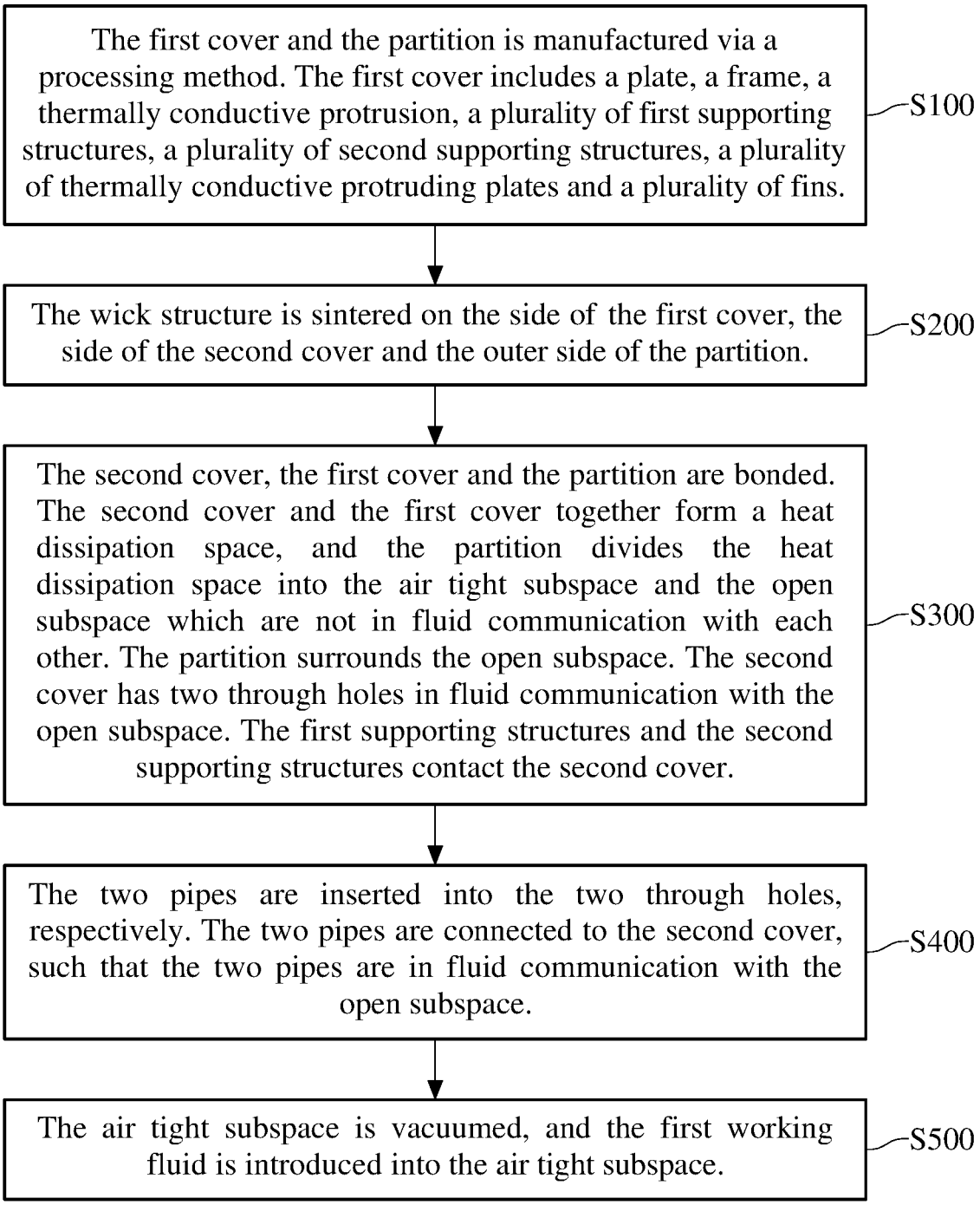
FIG. 6 is a flow chart showing the manufacture of the vapor chamber in FIG. 1.

Please refer to FIG. 6, which is a flow chart showing the manufacture of the vapor chamber 10 in FIG. 1. A step S100 is performed firstly. The first cover 11 and the partition 14 is manufactured via a processing method such as forging or computer numerical control (CNC). Then, a step S200 is performed. The wick structure 16 is sintered on the side of the first cover 11, the side of the second cover 12 and the outer side of the partition 14. Then, a step S300 is performed. The second cover 12, the first cover 11 and the partition 14 are bonded. The second cover 12 and the first cover 11 together form a heat dissipation space 15, and the partition 14 divides the heat dissipation space 15 into the air tight subspace 151 and the open subspace 152 which are not in fluid communication with each other. The partition 14 surrounds the open subspace 152. The second cover 12 has two through holes 121 in fluid communication with the open subspace 152. The first supporting structures 114 and the second supporting structures 115 contact the second cover 12. Then, a step S400 is performed. The two pipes 13 are inserted into the two through holes 121, respectively. The two pipes 13 are connected to the second cover 12 via, for example, welding, such that the two pipes 13 are in fluid communication with the open subspace 152. Finally, a step S500 is performed. The air tight subspace 151 is vacuumed, and the first working fluid is introduced into the air tight subspace 151. The manufacture of the vapor chamber 10 is completed so far.

Figure 7:
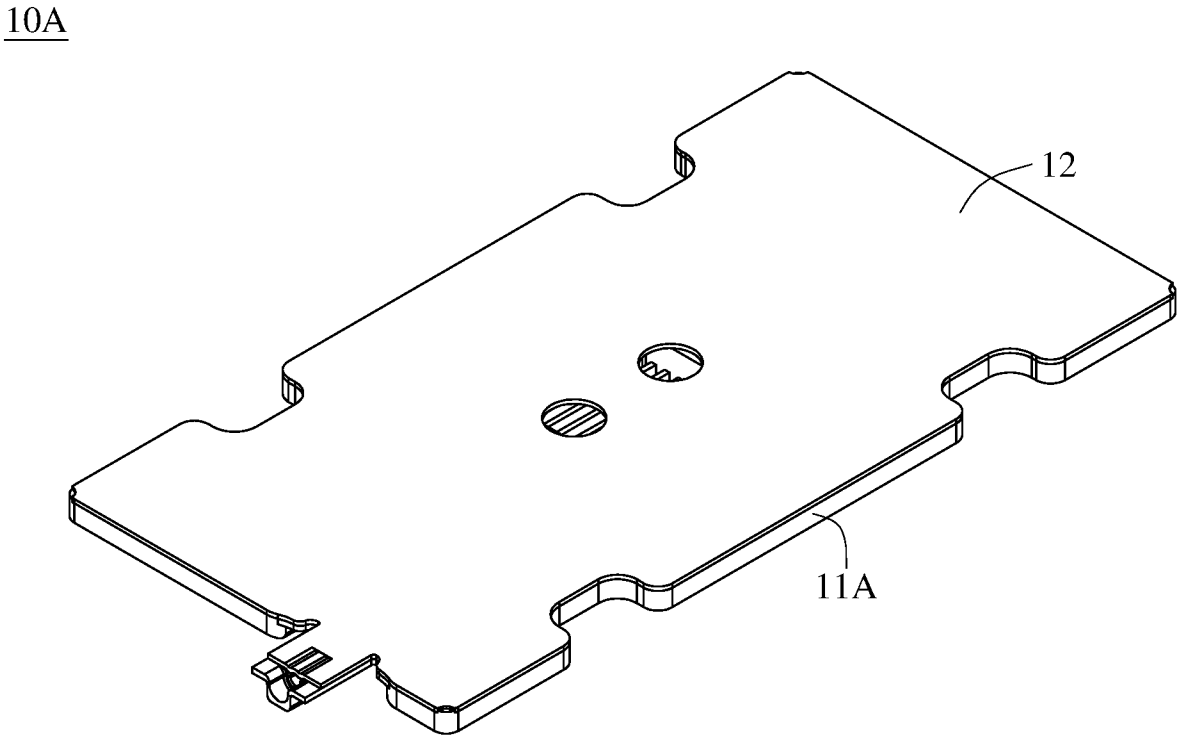
FIG. 7 is a perspective view of a vapor chamber in accordance with a second embodiment of the disclosure.
Figure 8:
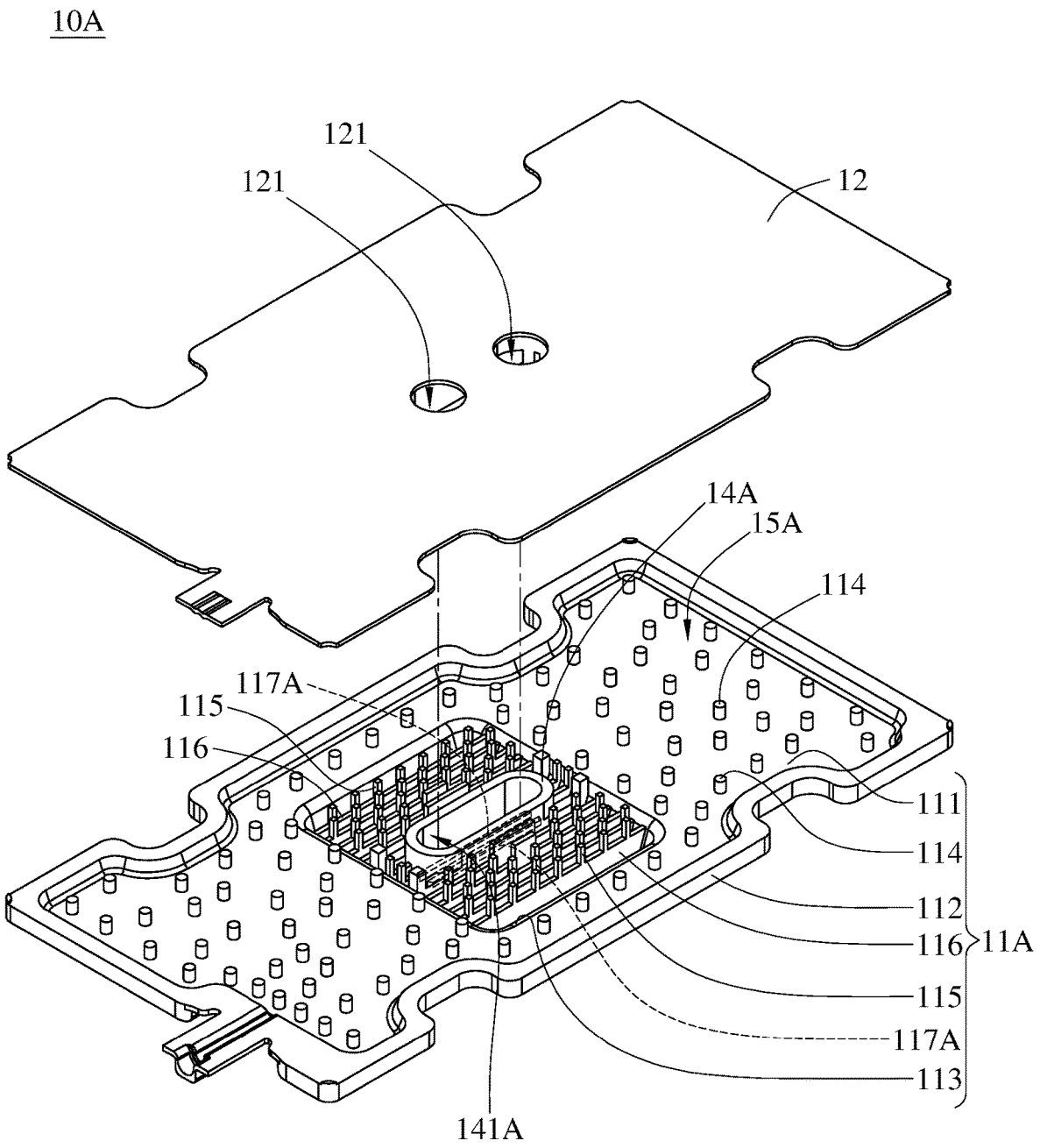
FIG. 8 is an exploded view of the vapor chamber in FIG. 7.
Figure 9:
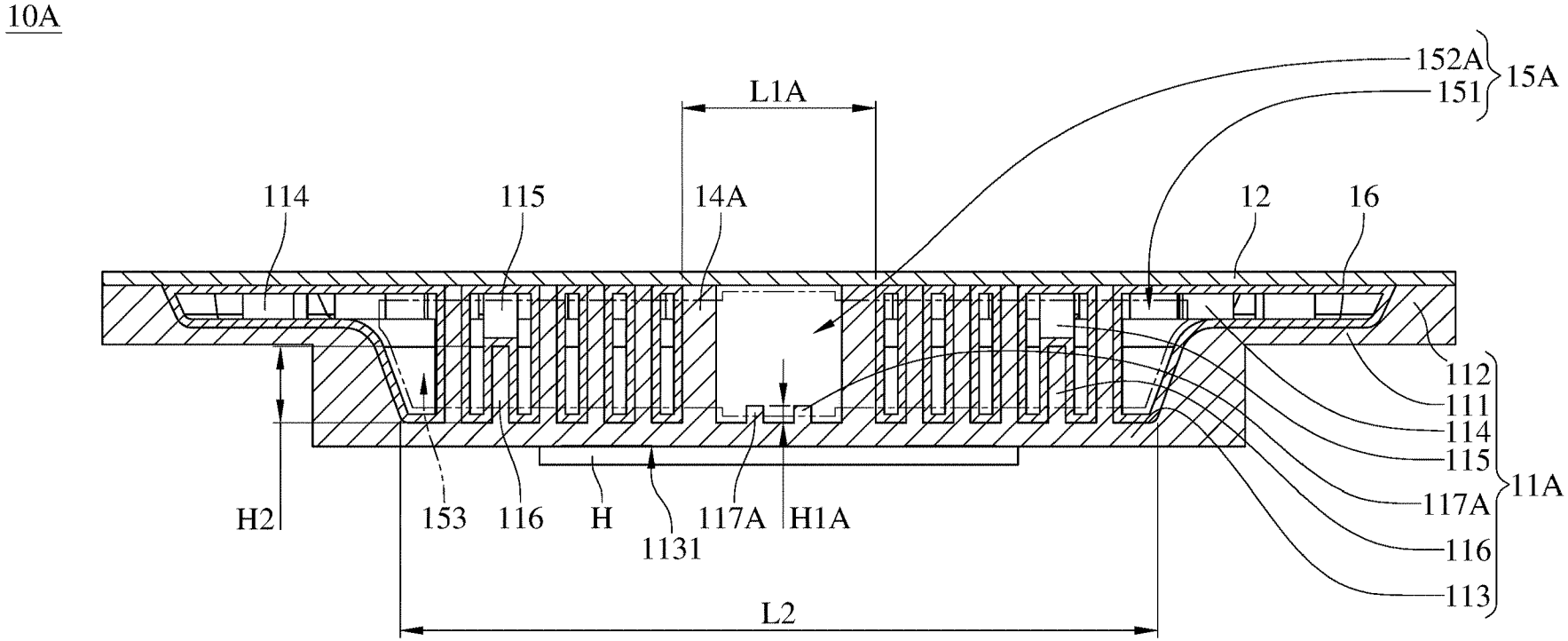
FIG. 9 is a cross-sectional view of the vapor chamber in FIG. 7.

Please refer to FIG. 7 to FIG. 9, where FIG. 7 is a perspective view of a vapor chamber 10A in accordance with a second embodiment of the disclosure, FIG. 8 is an exploded view of the vapor chamber 10A in FIG. 7, and FIG. 9 is a cross-sectional view of the vapor chamber 10A in FIG. 7.

The vapor chamber 10A of this embodiment is similar to the vapor chamber 10 of the first embodiment, the main difference between them will be described below, and the same parts between them can be referred to the aforementioned paragraphs with the reference to FIG. 1 to FIG. 6 and will not be repeatedly introduced hereinafter. In this embodiment, the vapor chamber 10A does not include two pipes 13 in the first embodiment. In this embodiment, a length LIA of a partition 14A of the vapor chamber 10A is, for example, ¼ to ⅓ of a length L2 of a thermally conductive protrusion 113 of the vapor chamber 10A. A length LIA of the partition 14A of the vapor chamber 10A is less than the length L1 of the partition 14 of the vapor chamber 10 of the first embodiment, and an open subspace 152A of the vapor chamber 10A is smaller than the open subspace 152 of the first embodiment, such that an area of an inner surface 141A of the partition 14A of the vapor chamber 10A is less than the contact area between the heat source H and the thermal contact surface 1131. In addition, a height H1A of each fin 117A of the vapor chamber 10A is lower than the height H1 of each fin 117 of the first embodiment, and is, for example, ¼ to ⅓ of a height H2 of each thermally conductive protruding plates 116 of the vapor chamber 10A.

According to the vapor chamber as described in the above embodiments, the partition divides the heat dissipation space into an air tight subspace and an open subspace which are not in fluid communication with each other, and the second working fluid located in the open subspace and cooling the hot spot of the heat source is driven by the external pump to reduce the time for the second working fluid to stay in open subspace. Thus, less heat generated by the hot spot of the heat source is transferred to the first working fluid located in the air tight subspace from the second working fluid via partition. Accordingly, the first working fluid located outside the hot spot of the heat source may not be excessively vaporized due to the heat generated by the hot spot so as to prevent the heat dissipation efficiency of the vapor chamber from being reduced.

In addition, the first working fluid located outside the hot spot of the heat source can cool the heat generated from a part of the heat source other than the hot spot, and the second working fluid can mainly cool the heat generated from the hot spot of the heat source. Therefore, the hot spot is allowed to be cooled via the second working fluid by a low wattage and low flow external pump, which improves a design freedom of the vapor chamber.

It will be apparent to those skilled in the art that various modifications and variations can be made to the present disclosure. It is intended that the specification and examples be considered as exemplary embodiments only, with a scope of the disclosure being indicated by the following claims.

What is claimed is:

1. A vapor chamber, comprising:

a first cover;

a second cover, wherein the second cover and the first cover are bonded together to form a heat dissipation space, the second cover has at least two through holes, the at least two through holes correspond to the heat dissipation space, and the at least two through holes are configured for at least two pipes to be inserted therein; and a partition, located in the heat dissipation space and protruding from the first cover, wherein the partition divides the heat dissipation space into an air tight subspace and an open subspace which are not in fluid communication with each other, the partition surrounds the open subspace, and the open subspace is in fluid communication with the at least two through holes:

wherein the first cover comprises a plate and a thermally conductive protrusion, the thermally conductive protrusion protrudes from the plate along a direction away from the heat dissipation space, the heat dissipation space has a vaporization area corresponding to the thermally conductive protrusion, the thermally conductive protrusion has a thermal contact surface facing away from the vaporization area, the thermal contact surface is configured to be thermally coupled heat source, the partition is located in the vaporization area, and the partition protrudes from the thermally conductive protrusion;

wherein the first cover comprises a plurality of first supporting structures and a plurality of second supporting structures, the plurality of first supporting structures protrude from the plate, the plurality of second supporting structures protrude from the thermally conductive protrusion, and the plurality of first supporting structures and the plurality of second supporting structures protrude toward and contact the second cover, wherein the first cover comprises a plurality of thermally conductive protruding plates, the plurality of thermally conductive protruding plates are located in the air tight subspace, the plurality of thermally conductive protruding plates protrude from the thermally conductive protrusion, the plurality of thermally conductive protruding plates are connected to the plurality of second supporting structures, and the plurality of thermally conductive protruding plates are arranged around the partition.

2. The vapor chamber according to claim 1, wherein a cross-section area of the air tight subspace surrounding an inner surface of the partition is less than or equal to a contact area between the heat source and the thermal contact surface.

3. The vapor chamber according to claim 1, further comprising a wick structure, wherein the wick structure is located in the air tight subspace, and the wick structure is stacked on the first cover, the second cover and a side of the partition.

4. The vapor chamber according to claim 1, wherein first cover comprises a plurality of fins, the plurality of fins are located in the open subspace.

5. The vapor chamber according to claim 4, wherein a height of each of the plurality of fins is ½ to ⅔ of a height of each of the plurality of thermally conductive protruding plates.

6. The vapor chamber according to claim 4, wherein a height of each of the plurality of fins is ¼ to ⅓ of a height of each of the plurality of thermally conductive protruding plates.

7. The vapor chamber according to claim 1, wherein a length of the partition is ½ to ⅔ of a length of the thermally conductive protrusion.

8. The vapor chamber according to claim 1, wherein a length of the partition is ¼ to ⅓ of a length of the thermally conductive protrusion.

9. The vapor chamber according to claim 1, wherein the at least two pipes are located in the vaporization area, and the at least two pipes are inserted into the at least two through holes.

* * * * *